US012654275B2

(12) United States Patent
Horl et al.

(10) Patent No.: US 12,654,275 B2
(45) Date of Patent: Jun. 16, 2026

(54) MAGNETIC SHARPENING JIG COMPRISING A FLEXIBLE CONTACT ELEMENT

(71) Applicant: Horl 1993 GmbH, Freiburg (DE)

(72) Inventors: Timo Horl, Freiburg (DE); Otmar Horl, Freiburg (DE)

(73) Assignee: HORL 1993 GMBH (DE)

( * ) Notice: Subject to any disclaimer, the term of this patent is extended or adjusted under 35 U.S.C. 154(b) by 103 days.

(21) Appl. No.: 18/044,325

(22) PCT Filed: Sep. 8, 2021

(86) PCT No.: PCT/EP2021/074644
§ 371 (c)(1),
(2) Date: Mar. 7, 2023

(87) PCT Pub. No.: WO2022/053477
PCT Pub. Date: Mar. 17, 2022

(65) Prior Publication Data

US 2023/0294233 A1 Sep. 21, 2023

(30) Foreign Application Priority Data

Sep. 9, 2020 (DE) ..... 10 2020 123 500.3

(51) Int. Cl.
*B24B 3/54* (2006.01)
*B24D 15/08* (2006.01)

(52) U.S. Cl.
CPC ..... *B24B 3/543* (2013.01); *B24B 3/546* (2013.01); *B24D 15/08* (2013.01)

(58) Field of Classification Search
None
See application file for complete search history.

(56) References Cited

U.S. PATENT DOCUMENTS 4,070,742 A 1/1978 Dorfman
4,627,194 A 12/1986 Friel
(Continued)

FOREIGN PATENT DOCUMENTS

CA 2053032 A1 4/1992
CN 118494346 A * 8/2024 ..... B62D 65/16
(Continued)

OTHER PUBLICATIONS

English translation of JP-3135496, date Sep. 20, 2007.*
English translation of DE-102020123503-A1, Mar. 10, 2022.*
International Search Report for PCT/EP2021/074644, mailed on Dec. 23, 2021, 2 pages.
Canadian Office Action issued in Canadian application 3192759, dated Jun. 27, 2024 (6 pages).
(Continued)

*Primary Examiner* — Hwei-Siu C Payer
(74) *Attorney, Agent, or Firm* — Harness, Dickey & Pierce, P.L.C.

(57) ABSTRACT

A magnetic sharpening jig, in particular for holding, by magnetic force, a cutting tool which is to be sharpened or polished and which includes a magnetizable blade, and for positioning said cutting tool relative to a sharpening and/or polishing tool, e.g. a rolling sharpener. In order to provide a versatile magnetic sharpening jig, the magnetic sharpening jig includes at least one flexible contact element with which the magnetically attracted blade of the cutting tool comes into contact during normal operation. Also disclosed are a set including a magnetic sharpening jig and a rolling sharpener, as well as a method for sharpening or polishing the cutting tool using the magnetic sharpening jig.

15 Claims, 2 Drawing Sheets

(56) References Cited

U.S. PATENT DOCUMENTS

| | | | | |
|---|---|---|---|---|
| 6,425,813 | B1 | 7/2002 | Ernst | |
| 7,724,611 | B2 | 5/2010 | Groothuis et al. | |
| 8,584,365 | B2 † | 11/2013 | Zeitlin | |
| 9,358,654 | B1 † | 6/2016 | Dovel | |
| 10,744,619 | B1 | 8/2020 | Boutorine | |
| 11,279,003 | B1 * | 3/2022 | McMahon | B24D 15/081 |
| 2003/0166386 | A1 | 9/2003 | McDonald | |
| 2007/0281594 | A1 * | 12/2007 | Jones | B24D 15/06 451/367 |
| 2014/0342644 | A1 | 11/2014 | Hasegawa | |

FOREIGN PATENT DOCUMENTS

| | | | | | |
|---|---|---|---|---|---|
| DE | 102016009482 | A1 | | 2/2018 | |
| DE | 202020001180 | U1 | | 4/2020 | |
| DE | 202020103080 | U1 | | 7/2020 | |
| DE | 102020123503 | A1 | * | 3/2022 | B24B 3/54 |
| EP | 3278928 | A2 | | 2/2018 | |
| JP | H02-160462 | A | | 6/1990 | |
| JP | H05-038666 | A | | 2/1993 | |
| JP | 3135496 | U | * | 9/2007 | |
| JP | 4060434 | B2 | * | 3/2008 | |
| JP | 2010-260160 | A | | 11/2010 | |
| JP | 2011104718 | A | † | 6/2011 | |
| JP | 3169468 | U | | 8/2011 | |
| JP | 2012-228750 | A | | 11/2012 | |
| JP | 2014-226777 | A | | 12/2014 | |
| KR | 200187604 | Y1 | | 7/2000 | |
| KR | 20180042930 | A | | 4/2018 | |
| KR | 20190003177 | U | | 12/2019 | |
| WO | WO2007100993 | A2 | † | 9/2007 | |
| WO | 2011123382 | A1 | | 10/2011 | |

OTHER PUBLICATIONS

Decision to Grant a Patent issued in Japanese application 2023-515582, dated Sep. 3, 2024 (6 pages).

Japanese Office Action issued in JP 2023-515582, mailed on Apr. 23, 2024 (10 pages).

Korean Office Action issued in KR Application No. 10-2023-7009212, dated Feb. 26, 2025 (11 pages).

German Office Action issued in DE Application No. 10-2020-123500.3, dated Jul. 29, 2021 (12 pages).

European Office Action issued in EP Application No. 21 773 745.1, dated May 20, 2025 (14 pages).

Chinese Office Action issued in CN Application No. 2021800618676, dated Dec. 7, 2025 (12 pages).

Brazilian Office Action issued in BR Application No. BR112023004025-6, dated Dec. 9, 2025 (10 pages).

Mexican Office Action issued in MX Application No. MX/a/2023/002830, dated Dec. 10, 2025 (18 pages).

European Office Action issued in EP Application No. 21 773 745.1, dated Jan. 28, 2026 (18 pages).

Korean Cancellation Request issued in KR Granted Patent Registration No. 10-2885500-00-00 dated Feb. 6, 2026 (119 pgs). (Partial English Translation).

Author: DonCaruso BBQ title: Messer richtig schärfen, der Rollschleifer von Horl publication date: Aug. 9, 2017 place of publication: Youtube (https://www.youtube.com/watch?v=jnuoVJfLefo).†

Author: The Show Channel title: Rollschleifer—Messer schärfen leicht gemacht—Das Ding des Jahres publication date: Mar. 13, 2019 place of publication: Youtube (https://www.youtube.com/watch?v=ZAnoSHdNJO8).†

* cited by examiner
† cited by third party

MAGNETIC SHARPENING JIG COMPRISING A FLEXIBLE CONTACT ELEMENT

CROSS-REFERENCE TO RELATED APPLICATIONS

The present application is a U.S. National Phase of International Application No. PCT/EP2021/074644, filed Sep. 8, 2021, which claims priority to German Application No. 10 2020 123 500.3, filed Sep. 9, 2020.

BACKGROUND

The present disclosure relates to a magnetic sharpening jig, in particular for holding, by magnetic force, a cutting tool with a magnetizable blade to be sharpened or polished and for positioning the same with respect to a sharpening and/or polishing tool such as a rolling sharpener.

A generic magnetic sharpening jig is known from DE 20 2020 001 180 U1. A rolling sharpener is known, for example, from EP 3 278 928 A.

The magnetic sharpening jig known from the prior art is adapted to specific blade dimensions and comprises two contact sides. Blades with a greater blade height are intended to contact one contact side of the magnetic sharpening jig and are supported backwards on the planar base so that the cutting edge of the cutting tool to be sharpened or polished projects beyond the upper side of the magnetic sharpening jig and is accessible for processing with the rolling sharpener. For blades with a lower blade height, a step is provided on the other contact side of the magnetic sharpening jig, on which the blade back can rest so that the cutting edge projects beyond the top of the magnetic sharpening jig and is accessible for processing with the rolling sharpener. The step for supporting the blade on the rear side is necessary with this magnetic sharpening jig to ensure a secure hold on the magnetic sharpening jig even when high forces are applied to the blade during the sharpening or polishing process.

Embodiments discussed herein provide a magnetic sharpening jig which can be used in a more versatile manner and with which blades of different sizes and geometries can be positioned reliably on the magnetic sharpening jig.

The magnetic sharpening jig according to embodiments discussed herein serves in particular for holding a cutting tool to be sharpened or polished with a magnetizable blade by means of magnetic force and for positioning the same relative to a sharpening and/or polishing tool such as a rolling sharpener. In some embodiments, the magnetic sharpening jig has at least one flexible contact element with which the magnetically attracted blade of the cutting tool comes into contact as intended.

An advantage of embodiments discussed herein compared to the prior art is essentially that the flexible contact element significantly increases the static friction of the blade on the magnetic sharpening jig. The static friction of the blade on the magnetic sharpening jig is largely defined by the magnetic holding force and the static friction coefficient of the contact element. The flexible contact element has a very high static friction coefficient with respect to the magnetizable blade, in particular made of metal. The static friction coefficient of the flexible contact element compared to the magnetizable blade is usually significantly higher than that of the body of the magnetic sharpening jig, which is made of wood, plastic or metal, for example. Due to its flexibility, the contact element adapts ideally to the surface of the blade and, if necessary, ensures extensive contact with the blade while compensating for unevenness. This further improves the static friction between the contact element and the blade. Due to the flexible contact element, the blade of the cutting tool can be held on the magnetic sharpening jig by magnetic force alone, even without a rear side support or step. Even when force is applied to the blade with the sharpening and/or polishing tool in the course of the sharpening or polishing process, the blade remains fixed in the intended holding position on the magnetic sharpening jig. The flexible contact element thus considerably improves the static friction and holding properties of the magnetic sharpening jig. Relative movement between the magnetic sharpening jig and the blade of the cutting tool is prevented by the flexible contact element. This prevents damage to the blade, such as scratches. In addition, the flexible contact element ensures damping of the impact when the blade of the cutting tool is magnetically attracted to a body of the magnetic sharpening jig. In this case, the flexible contact element ensures a better contact noise and a better contact response to the body of the magnetic sharpening jig.

It can be advantageous if the contact element is made of plastic, preferably an elastomer, preferably a vulcanizate of natural rubber or silicone rubber (silicone). Silicone is an inexpensively available material with excellent static friction and damping properties. For the present application, a contact element made of silicone proves to be optimal. However, the flexible contact element can also be, for example, a metal plate with rubber coating or vulcanized surface or a sprayed-on coating.

It may prove useful if the contact element has a Shore A hardness in the range 1 to 90, preferably in the range 20 to 40. In principle, the static friction coefficient of the contact element increases with decreasing Shore A hardness. On the other hand, the load-bearing capacity and dimensional stability of the contact element increase with increasing Shore A hardness. A contact element with low Shore A hardness, for example in the range of 20 to 40, in particular in the range of 20 to 30, proves to be optimal. The Shore A hardness is preferably measured according to DIN EN ISO 868, DIN ISO 7619-1 and ASTM D2240-00.

It may prove helpful if the magnetic sharpening jig has a body on which the contact element is arranged, wherein preferably the body of the magnetic sharpening jig is partly or entirely made of wood and/or plastic and/or metal.

It can be useful if the contact element has a higher flexibility than the body and/or a magnet of the magnetic sharpening jig. In this way, the contact element dampens a contact impact between the blade and the body and/or magnet of the magnetic sharpening jig.

It can be useful for the magnetic sharpening jig to have at least one contact side on which the contact element is arranged, wherein the contact element covers the contact side in sections or covers the entire surface. In this way, unintentional contact of the blade with the body of the magnetic sharpening jig can be prevented. In addition, the contact element can be colored and used as a decorative element on the body of the magnetic sharpening jig.

It may prove practical if the magnetic sharpening jig has at least one magnet for generating the magnetic force, wherein the contact element covers one, several or all magnet(s) of the magnetic sharpening jig in sections or covers the entire surface (preferably such that the magnet is not visible). In this way, unintentional contact of the blade with the magnet can be prevented.

It may be helpful if the contact element is configured to elastically deform under the action of the magnetically attracted cutting tool, preferably to form a negative shape for a portion of the blade of the cutting tool in contact with the contact element. In particular, this allows the magnetically attracted blade of the cutting tool to be pressed into the contact element under elastic deformation of the latter and thus to be held not only frictionally but also positively on the contact element if necessary. In particular, if the back of the magnetically sharpened blade runs across the contact element, the back of the blade can "dig" into the contact element. A step supporting the rear side of the blade can form below the back of the blade. In this way, the blade can be held securely with the magnetic sharpening jig even when considerable force is applied by a sharpening or polishing tool. For this purpose, it is useful if the contact element projects from a planar contact side of a body of the magnetic sharpening jig so that the body of the magnetic sharpening jig does not interfere with elastic deformation of the contact element by the magnetically attracted blade.

It may be preferred if the contact element is configured such that contact between the magnetically attracted cutting tool and a body of the magnetic sharpening jig and/or at least one magnet of the magnetic sharpening jig is partially or completely prevented. This prevents the magnetically attracted blade of the cutting tool from being scratched or otherwise damaged.

It can be useful if the contact element has a planar contact surface for the blade of the cutting tool. This allows the blade to be positioned freely relative to the contact surface.

It may prove useful if the contact element has at least one marking which preferably indicates the amount of a sharpening angle, wherein the marking is preferably formed as a recess in the contact surface of the contact element, wherein the marking is particularly preferably arranged centrally in the contact surface. The marking facilitates the operation of the magnetic sharpening jig for a user. Particularly in the case of a magnetic sharpening jig with several different contact sides, the marking makes it easier for the user to find a contact side with a suitable sharpening angle.

It may be useful if the magnetic sharpening jig comprises a plurality of contact elements, preferably arranged on different, preferably on contact sides of a body of the magnetic sharpening jig facing away from or opposite to each other, wherein the contact elements preferably include different acute angles with an installation plane of the magnetic sharpening jig. The sharpening angle, which is preferably measured between the surface of the contact element (or contact surface) and a plane aligned perpendicular to the base, is preferably in the range between 15° and 20°. The sharpening surface of a rolling sharpener is usually aligned in a plane perpendicular to the base. The angle between the contact surface of the contact element and the base is preferably in the range between 70° and 75°.

Another aspect relates to a set comprising a magnetic sharpening jig according to one of the preceding embodiments and a rolling sharpener, preferably a rolling sharpener according to EP 3 278 928 A. Such a rolling sharpener is movable in a rolling manner over a base and has at least one end-face sharpening or polishing surface.

Still another aspect relates to a method of sharpening or polishing a cutting tool using the magnetic sharpening jig according to one of the preceding embodiments, comprising the steps of:

Step A: Arranging the magnetic sharpening jig on a base.

Step B: Providing a cutting tool with a magnetizable blade and a cutting edge attached to it.

Step C: Arranging the blade in the magnetic field of the magnetic sharpening jig so that the blade is magnetically attracted and comes into contact with the contact element, preferably over the entire surface.

Step D: Sharpening or polishing the cutting edge of the cutting tool with a sharpening and/or polishing tool, preferably a rolling sharpener.

Step A preferably involves a horizontally aligned, planar base, e.g. a tabletop or kitchen countertop. A cutting tool with magnetizable blade in the sense of step B is, for example, a conventional kitchen knife with stainless steel blade. In step C, the blade of the magnetizable blade is preferably aligned parallel to the contact surface, as shown in FIG. 6, preferably such that the blade back is facing the base and the blade edge is facing away from the base. If the blade is magnetically attracted by the magnetic sharpening jig in this state, then only the blade with the blade surface comes into contact with the contact element in a planar manner, ideally over the entire surface, so that the cutting edge is accessible for sharpening or polishing. The sharpening in step D is preferably, but not necessarily, performed with a rolling sharpener. A rolling sharpener with an end-face sharpening or polishing surface is moved horizontally in a rolling motion over the planar base and is held in contact with the cutting edge of the blade of the cutting tool with the sharpening or polishing surface aligned in a vertical plane. The movement direction of the rolling sharpener is approximately parallel to the extension direction of the blade. The sharpening angle is defined by the plane in which the blade is held in contact with the contact element and the vertical plane of the sharpening or polishing surface. A rolling sharpener is known, among other things, from EP 3 278 928 A.

It can be advantageous if the blade is arranged in step C such that the blade is spaced apart from the base and/or the cutting edge is facing away from the base. This makes the blade easily accessible for machining.

The contact element of the magnetic sharpening jig preferably has at least one of the following features:

The contact element is made of plastic, preferably an elastomer, preferably a vulcanizate of natural rubber or silicone rubber (silicone).

The contact element has a Shore A hardness in the range of 1 to 90, preferably in the range of 20 to 40.

The contact element has a compressive modulus of flexibility in the range of 0.1 to 30 MPa, preferably in the range of 0.2 to 10 MPa, more preferably in the range of 0.25 to 2 MPa.

The contact element has a thickness in the range of 0.1 to 2 mm, preferably a thickness in the range of 0.2 to 1 mm, more preferably a thickness in the range of 0.3 to 0.5 mm.

The contact element has at least one planar contact surface, preferably several planar contact surfaces, preferably with different contact angles.

The contact element has a planar mounting surface with which the contact element is attached to a body of the magnetic sharpening jig, wherein the mounting surface is preferably aligned parallel to the contact surface.

The contact element is firmly connected, preferably bonded, to a body and/or a magnet of the magnetic sharpening jig.

The contact element is configured as a cuboid body.

The contact element has a marking, which is preferably introduced into the contact surface as a recess.

The contact element has a rectangular outline.

The contact element covers a contact side of the body of the magnetic sharpening jig in sections or over the entire surface.

The contact element covers or closes at least one magnet receiving opening in the body of the magnetic sharpening jig in sections or over the entire surface.

The contact element has, preferably at the contact surface, a static friction coefficient with respect to steel, in particular stainless steel, of more than 0.2, preferably more than 0.4, preferably more than 0.6, particularly preferably more than 0.8.

The contact element has a higher static friction coefficient than a body and/or magnet of the magnetic sharpening jig.

The contact element is transparent, translucent or opaque.

The contact element is colored with pigments.

The contact element has a bottom and/or embedded and/or top decoration.

The contact element has an anti-slip surface.

The contact element is formed as a coating of a body and/or a magnet of the magnetic sharpening jig.

The contact element is molded onto a body and/or a magnet of the magnetic sharpening jig. A body of the magnetic sharpening jig preferably has at least one of the following features:

The body has a length in the range of 50 to 150 mm, preferably a length in the range of 80 to 120 mm.

The body has a height in the range of 15 to 30 mm, preferably a height in the range of 20 to 25 mm.

The body has a width in the range of 40 to 80 mm, preferably a width in the range of 50 to 60 mm.

The body is made of wood and/or plastic and/or metal at least in sections.

The body has a trapezoidal cross-section in a first cross-sectional plane intersecting—preferably perpendicularly—the contact element, wherein the cross-section preferably tapers towards the lower side.

The body has a rectangular cross-section in a second cross-sectional plane not intersecting the contact element, wherein the second cross-sectional plane is preferably aligned perpendicular to the first cross-sectional plane.

The body has a rectangular outline in top view and/or bottom view.

The body has, preferably in a contact side, at least one opening for receiving at least one magnet, wherein the opening is preferably cylindrical and is preferably worked into the body of the magnetic sharpening jig perpendicular to the contact side.

The body has a larger upper side than lower side.

The body tapers from the top to the bottom, preferably steadily.

The body has exclusively planar sides.

The body is more chamfered or rounded on at least one edge defining the top than on at least one edge defining the bottom.

A magnet of the magnetic sharpening jig preferably has at least one of the following features:

The magnet is a permanent magnet.

The magnet includes a cylindrical outer contour.

The magnet is accurately fitted in a receptacle in the body of the magnetic sharpening jig.

The magnet comprises at least one planar end face.

The magnet is flush with the body of the magnetic sharpening jig at the end face.

The magnet is partially covered or fully concealed by the contact element on the end face.

There are several, preferably identical magnets on each contact side of the magnetic sharpening jig.

The holding force of the magnet is preferably in the range of 0.1 to 10 kg, preferably in the range of 0.2 to 5 kg, particularly preferably in the range of 0.5 to 4 kg.

An installation section of the magnetic sharpening jig preferably has at least one of the following features:

The installation section comprises a head and a shaft projecting from the head.

A shaft of the installation section comprises at least one circumferential retaining rib.

The installation section is configured as a plastic plug.

The shaft of the installation section comprises at least one holding section that can be fixed to the body of the magnetic sharpening jig.

The holding section is configured in the shape of a fir tree.

The holding section has a sawtooth structure in cross-section.

The holding section is wedge-shaped.

The holding section tapers towards the end of the shaft facing away from the head.

The flanks of the shaft are inclined at a smaller angle to the shaft axis in the insertion direction, i.e. to the end of the shaft facing away from the head, than in the opposite direction.

A force to insert the shaft into a corresponding opening of the body is less than a force required to pull the shaft out of this opening again.

The installation section is made of plastic, preferably an elastomer, preferably a vulcanizate of natural rubber or silicone rubber (silicone).

The installation section has a Shore A hardness in the range of 20 to 80 preferably in the range of 40 to 60.

Further preferred embodiments result from combinations of the features disclosed, the description, and the drawings.

DETAILED DESCRIPTION OF THE PREFERRED EMBODIMENTS

Figure 1:
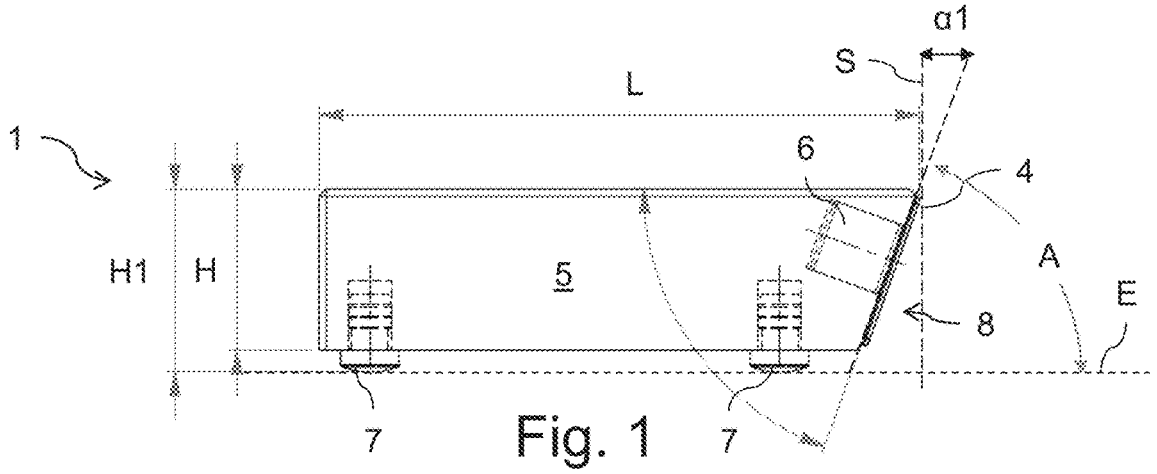
FIG. 1: shows a side view of a magnetic sharpening jig according to the first embodiment, wherein the concealed components are shown in dashed lines.
Figure 2:
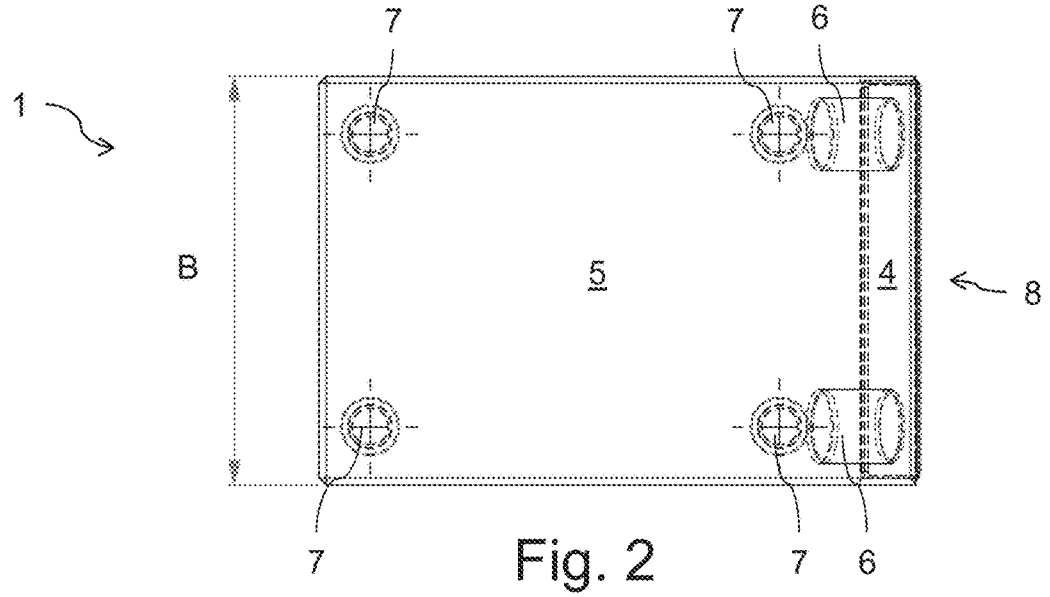
FIG. 2: shows a top view of the magnetic sharpening jig of FIG. 1.

The magnetic sharpening jig 1 serves for holding, by magnetic force, a cutting tool 2 to be sharpened or polished with a magnetizable blade 2*a* and for positioning the same relative to a sharpening and/or polishing tool such as a rolling sharpener 3. The magnetic sharpening jig 1 comprises at least one flexible contact element 4 with which the magnetically attracted blade 2*a* of the cutting tool 2 comes into contact as intended. The magnetic sharpening jig 1 is independent of the cutting tool 2 and its blade 2*a*. Therefore, the description focuses on the magnetic sharpening jig 1, in which the blade of the cutting tool 2 contacts the contact element 4 in a planar manner, as is clearly shown in FIGS. 3 and 6. In use, ideally only the magnetically attracted blade 2*a* of the cutting tool 2 comes into contact with the contact element 4 over the surface or the entire surface, wherein any contact of the cutting tool 2 with a body 5 or magnet 6 of the magnetic sharpening jig 1 is omitted.

The magnetic sharpening jig 1 is adapted in particular for positioning cutting tools 2 in the form of kitchen knives. Kitchen knives often have a stainless steel blade 2*a* with an approximately planar blade and a slightly curved, one-sided cutting edge 2*b*. However, it is possible in principle that, apart from kitchen knives, other cutting tools 2 can also be positioned with the magnetic sharpening jig 1.

The shape of the cutting tool 2 and the blade 2*a* are therefore not decisive. The advantage of the magnetic sharpening jig 1 lies precisely in the fact that it can be used universally for different blade sizes and geometries.

Preferred embodiments are explained below with reference to the Figures.

First Embodiment (FIGS. 1 to 3 and 6)

The magnetic sharpening jig 1 according to the first embodiment is described below with reference to FIGS. 1 to 3 and 6.

The magnetic sharpening jig 1 comprises an approximately cuboidal body 5, which has a trapezoidal cross-section in a cross-sectional plane intersecting the contact element 4 perpendicularly (parallel to the blade plane or drawing surface) as shown in FIG. 1.

On the lower side of the body 5, flexible installation sections 7 are located in the corner regions in each case and are inserted in a frictional manner into corresponding openings on the lower side of the body 5. Each installation section 7 is configured as a plastic plug and comprises a head and a shaft projecting from the head with a fir-tree structure, wherein the individual holding ribs have a saw-tooth structure in cross-section. The holding ribs are wedge-shaped and taper towards the end of the shaft projecting from the head. The flanks of the shaft and the holding ribs attached to it are inclined in the insertion direction, i.e. towards the end of the shaft facing away from the head, at a smaller angle to the shaft axis than in the opposite direction. Accordingly, a force to insert the shaft into the corresponding opening of the body 5 is less than a force required to withdraw it again from this opening. The plastic plug is preferably made of silicone and preferably has a Shore A hardness in the range of 40 to 60.

Figure 3:
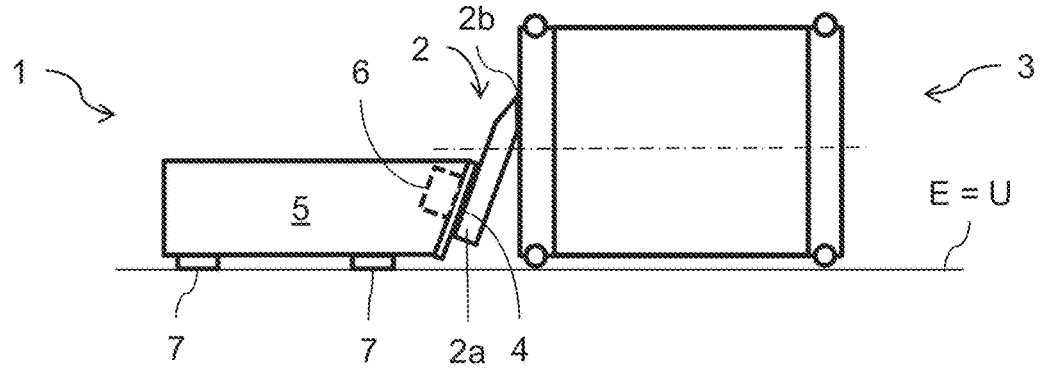
FIG. 3: shows a schematic view of an arrangement comprising a magnetic sharpening jig according to FIGS. 1 and 2, a cutting tool to be sharpened or polished, and a sharpening and/or polishing tool in the form of a rolling sharpener, wherein the blade of the cutting tool is held magnetically in contact with the flexible contact element of the magnetic sharpening jig so that the back of the blade is at a distance from the base and the cutting edge of the cutting tool faces away from the base.
Figure 6:
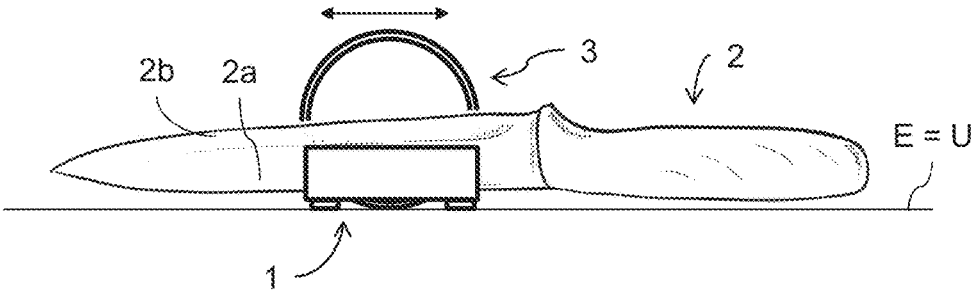
FIG. 6: shows the arrangement according to FIG. 3 from a different perspective.

In a state in which the installation sections 7 are inserted into the cylindrical recesses on the lower side of the body 5 and are positioned there in a frictional manner, the slightly rounded heads of these installation sections 7 project beyond the lower side of the body 5 of the magnetic sharpening jig 1 and define an installation plane E for setting up the magnetic sharpening jig 1 on a flat base U (see FIGS. 3 and 6). As shown in, for example. FIG. 3, the installation plane E corresponds to a plane of the flat base U upon which the magnetic sharpening jig is placed for use so that the flat base faces the lower side of the body 5.

The body 5 of the magnetic sharpening jig 1 is preferably made of untreated or varnished wood (e.g. oak, walnut, beech or spruce) and preferably has exclusively planar sides. The edges on the lower side of the body 5 are preferably more weakly chamfered or rounded than the other edges of the body 5.

In the first embodiment, the body 5 of the magnetic sharpening jig 1 has a length L of approx. 82 mm (measured at the top), a height H of approx. 22 mm and a width B of approx. 56 mm. Including the installation sections 7, the height H1 of the magnetic sharpening jig 1 is approximately 25 mm.

The side of the body 5 that is angled relative to the installation plane E of the magnetic sharpening jig 1 and forms an acute angle A (90°-α1) of, for example, 70° with it, and forms the contact side 8 of the magnetic sharpening jig 1. The sharpening angle α1 formed on this side of the magnetic sharpening jig 1 is 20° and corresponds to the angle between the contact side 8 and a vertical sharpening plane S aligned perpendicular to the installation plane E, in which the sharpening or polishing surface of a rolling sharpener 3 is located and moves. In this embodiment, the side of the body 5 opposite the contact side 8 is aligned parallel to the sharpening plane S.

Two, preferably cylindrical, bores are made in the contact side 8 of the body 5, into which correspondingly shaped, cylindrical magnets 6 are inserted with a precise fit in order to be flush with the contact side 8 of the body 5 at the end face.

The contact side 8 of the body 5 and the outward-facing end faces of the magnets 6 inserted in the bores are covered and bonded over their entire surface by a flexible silicone contact element 4 with a rectangular outline. The contact element 4 has a thickness in the range of, for example, 0.5 mm and a Shore A hardness of, for example, 30. On its side facing away from the body 5, the contact element 4 forms a planar contact surface for the blade 2*a* of the cutting tool 2, against which the blade can ideally abut over the entire surface without the cutting tool 2 coming into contact with the body 5 of the magnetic sharpening jig 1. Optionally, a marking for indicating the amount ("20°") of the respective contact angle α1 is provided on the contact surface of the contact element 4, e.g. it is worked into the center of the contact element 4 as a recess. Marking in the form of an imprint is also possible.

To sharpen or polish a cutting tool 2 with the magnetic sharpening jig 1, the magnetic sharpening jig 1 is placed with the installation sections 7 on a planar base U (step A). A provided cutting tool 2 with magnetizable blade 2*a* and cutting edge 2*b*, such as a kitchen knife with stainless steel blade (step B), is arranged with its magnetizable blade 2*a* in the magnetic field of the magnetic sharpening jig 1 as intended in such a way that the blade is aligned parallel to the contact surface of the contact element 4 and only the magnetically attracted blade 2*a* comes into (full) surface contact with the contact element 4. The cutting edge 2*b* faces away from the base U and the blade 2*a* is spaced apart from the base U. The blade 2*a* is thus held in contact with the contact element 4 solely by the magnet force of the magnetic sharpening jig 1. The flexible contact element 4 is elastically deformed by the blade 2*a* under the influence of the magnetic force until a force equilibrium is reached between the flexible restoring force of the contact element 4 and the magnetic force of the magnetic sharpening jig 1 exerted on the blade 2*a*. With a correspondingly soft and flexible contact element 4, the magnetically attracted blade 2*a* presses into the contact element 4. If the back of the blade runs across the contact element 4, a step is formed on the rear side of the blade 2*a* due to the elastic deformation of the contact element 4, which makes it even more difficult for the blade 2*a* held in contact with the contact element 4 to move. In this state, the blade 2*a* of the cutting tool 2 is machined with the rolling sharpener 3 with at least one end-face sharpening or polishing surface. The rolling sharpener 3 rolls horizontally over the flat base U and is held in contact with the cutting edge 2*b* of the blade 2*a* of the cutting tool 2 with the grinding or polishing surface aligned in a vertical plane. The direction of movement of the rolling sharpener 3 is approximately parallel to the extension direction of the blade. The sharpening angle α is defined by the plane of extension of the blade held in contact with the contact element 4 as intended and the vertical plane of the sharpening or polishing surface of the rolling sharpener 3.

Figure 4:
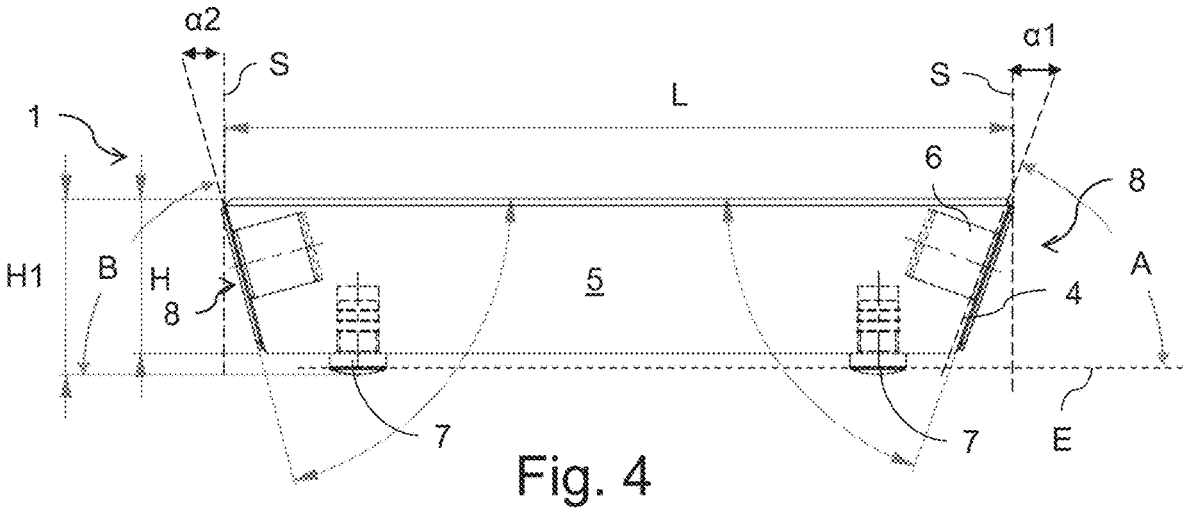
FIG. 4: shows a side view of a magnetic sharpening jig according to the second embodiment, wherein the concealed components are shown in dashed lines.
Figure 5:
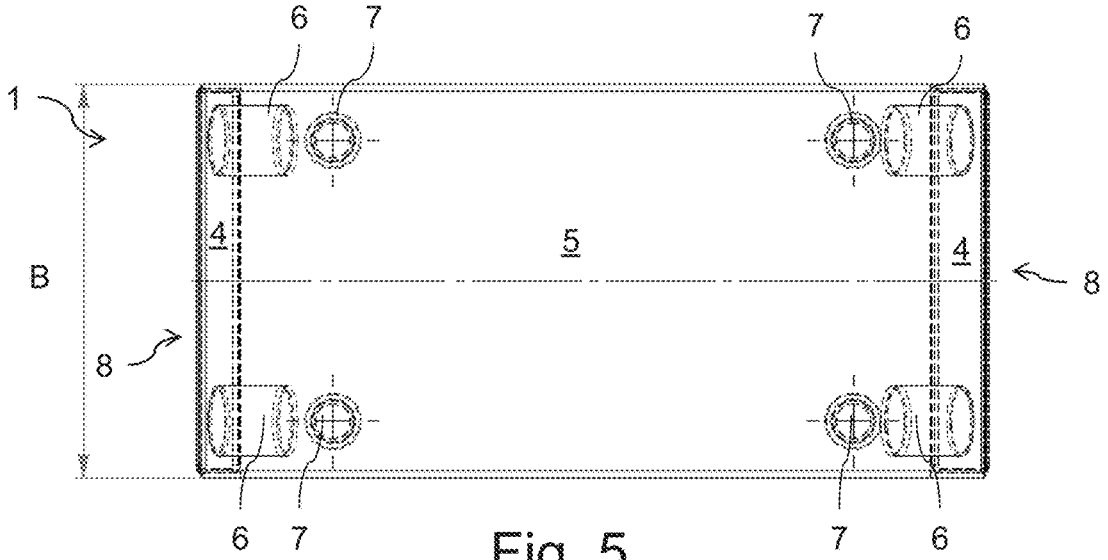
FIG. 5: shows a top view of the magnetic sharpening jig shown in FIG. 4.

In the second embodiment, described below with reference to FIGS. 4 and 5, the magnetic sharpening jig 1 includes features substantially identical to those in the first embodiment, with differences explained below: Deviating from the first embodiment, the magnetic sharpening jig 1 of the second embodiment comprises two different contact sides 8 on sides of the body 5 facing away from each other, each of which is fully covered with its own flexible contact element 4. The respective contact element 4 is exactly the same size as the contact side 8 of the body 5 of the magnetic sharpening jig 1 covered by it. A blade 2*a* of a cutting tool 2 attracted by magnetic force thus comes into contact exclusively with the respective contact element 4 and not, for example, with the body 5 of the magnetic sharpening jig 1 or even the magnets 6 arranged therein. One contact side 8 of the body 5 forms an acute angle A (90%-α1) relative to the installation plane E, while the other contact side 8 of the body 5 forms an acute angle B (90°-α2) relative to the installation plane E. Thus, the grinding angles α1, α2 are formed differently on the two contact sides 8 of the body 5. For example, the grinding angle α1 is 20° and the grinding angle α2 is 15°.

In the second embodiment, the body 5 of the magnetic sharpening jig 1 has a length L of approx. 112 mm (measured at the top), a height H of approx. 22 mm and a width B of approx. 56 mm. Including the installation sections 7, the height H1 of the magnetic sharpening jig 1 is approximately 25 mm.

LIST OF REFERENCE SIGNS

1 magnetic sharpening jig
2 cutting tool (knife)
2*a* blade
2*b* cutting edge
3 rolling sharpener
4 contact element
5 body
6 magnet
7 installation section
8 contact side
E installation plane
S sharpening plane
U base

What is claimed is:

1. A magnetic sharpening jig configured to hold and position, by magnetic force, a cutting tool which includes a magnetizable blade relative to a rolling sharpener, the magnetic sharpening jig comprising:

a body including:

a lower side;

an upper side that is larger than the lower side;

a first side slanting from the upper side to the lower side;

a second side slanting from the upper side to the lower side, the second side facing away from the first side;

a first contact side on the first side; and a second contact side on the second side, the second contact side facing away from the first contact side;

multiple magnets for generating the magnetic force;

a first flexible contact element on the first side of the body, the first flexible contact element covering the first contact side; and a second flexible contact element on the second side of the body, the second flexible contact element covering the second contact side, the first and second flexible contact elements being configured to respectively come into contact with the magnetizable blade of the cutting tool, the first flexible contact element being disposed directly on and covering a first plurality of the multiple magnets, and the second flexible contact element being disposed directly on and covering a remaining plurality of the multiple magnets; and wherein the first side of the body forms a first acute angle with respect to an installation plane of the magnetic sharpening jig corresponding to a plane of a flat base upon which the magnetic sharpening jig is placed for use so that the flat base faces the lower side of the body, the second side of the body forms a second acute angle with respect to the installation plane of the magnetic sharpening jig corresponding to the plane of the flat base upon which the magnetic sharpening jig is placed for use so that the flat base faces the lower side of the body, the second acute angle is a different angle than the first acute angle, and each of the first and second flexible contact elements has a thickness in a range of 0.1 to 2 mm.

2. The magnetic sharpening jig according to claim 1, wherein each of the first and second flexible contact elements is made of a vulcanizate of natural rubber or silicone rubber.

3. The magnetic sharpening jig according to claim 1, wherein each of the first and second flexible contact elements has a Shore A hardness in a range from 20 to 40.

4. The magnetic sharpening jig according to claim 1, wherein the body of the magnetic sharpening jig consists entirely of wood or plastic or metal.

5. The magnetic sharpening jig according to claim 4, wherein each of the first and second flexible contact elements has a higher flexibility than the body and/or the multiple magnets of the magnetic sharpening jig.

6. The magnetic sharpening jig according to claim 5, wherein the first flexible contact element covers the first contact side in sections or covers an entire surface of the first contact side, and the second flexible contact element covers the second contact side in sections or covers an entire surface of the second contact side.

7. The magnetic sharpening jig according to claim 4, wherein the first flexible contact element covers the first contact side in sections or covers an entire surface of the first contact side, and the second flexible contact element covers the second contact side in sections or covers an entire surface of the second contact side.

8. The magnetic sharpening jig according to claim 1, wherein each of the first and second flexible contact elements is configured to elastically deform by action of the cutting tool to form a negative shape for a portion of the blade of the cutting tool being in contact with the contact element.

9. The magnetic sharpening jig according to claim 1, wherein each of the first and second flexible contact elements is configured such that contact between the cutting tool and the body of the magnetic sharpening jig and/or the multiple magnets of the magnetic sharpening jig is partially or completely prevented.

10. The magnetic sharpening jig according to claim 1, wherein each of the first and second flexible contact elements has a planar contact surface for contacting the blade of the cutting tool.

11. A set comprising the magnetic sharpening jig according to claim 1 and the rolling sharpener.

12. A method for sharpening or polishing the cutting tool using the magnetic sharpening jig according to claim 1, comprising:

a step A of arranging the magnetic sharpening jig on the flat base;

a step B of providing the cutting tool with the magnetizable blade and a cutting edge arranged thereon;

a step C of arranging the blade in a magnetic field of the magnetic sharpening jig so that the blade is magnetically attracted and comes into contact, with an entire surface of one of the first and second flexible contact elements; and a step D of sharpening or polishing the cutting edge of the cutting tool with the rolling sharpener.

13. The method according to claim 12, wherein the blade is arranged in step C such that:

the blade is spaced apart from the flat base; and/or the cutting edge is facing away from the flat base.

14. The magnetic sharpening jig according to claim 1, wherein the range is 0.2 to 1 mm.

15. The magnetic sharpening jig according to claim 1, wherein the range is 0.3 to 0.5 mm.

* * * * *